US009211432B1

(12) United States Patent
Bennett

(10) Patent No.: US 9,211,432 B1
(45) Date of Patent: Dec. 15, 2015

(54) CHAIR EXERCISE SYSTEMS

(71) Applicant: Sherma Bennett, Brooklyn, NY (US)

(72) Inventor: Sherma Bennett, Brooklyn, NY (US)

( * ) Notice: Subject to any disclaimer, the term of this patent is extended or adjusted under 35 U.S.C. 154(b) by 212 days.

(21) Appl. No.: 13/863,124

(22) Filed: Apr. 15, 2013

Related U.S. Application Data

(60) Provisional application No. 61/625,709, filed on Apr. 18, 2012.

(51) Int. Cl.

| | |
|---|---|
| ***A63B 21/02*** | (2006.01) |
| ***A63B 21/05*** | (2006.01) |
| ***A63B 21/04*** | (2006.01) |
| *A63B 21/00* | (2006.01) |
| *A63B 21/16* | (2006.01) |
| *A63B 71/00* | (2006.01) |

(52) U.S. Cl.
CPC ..... *A63B 21/05* (2013.01); *A63B 21/0442* (2013.01); *A63B 21/154* (2013.01); *A63B 2021/1609* (2013.01); *A63B 2071/0018* (2013.01)

(58) Field of Classification Search
CPC .. A47C 9/002; A47C 9/005; A63B 21/00058; A63B 21/00101; A63B 21/02; A63B 21/028; A63B 21/0442; A63B 21/055; A63B 21/0552; A63B 21/0557; A63B 2021/1609
USPC ..... 482/44–46, 49, 50, 114–116, 118, 482/120–122, 124, 126, 129, 130, 133, 139, 482/142, 904
See application file for complete search history.

(56) References Cited

U.S. PATENT DOCUMENTS

| | | | | |
|---|---|---|---|---|
| 4,572,501 | A | 2/1986 | Durham et al. | |
| 4,685,670 | A * | 8/1987 | Zinkin | 482/129 |
| 4,913,423 | A * | 4/1990 | Farran et al. | 482/130 |
| 6,159,133 | A | 12/2000 | Shugg | |
| 6,334,624 | B1 | 1/2002 | Giglio | |
| 6,958,032 | B1 * | 10/2005 | Smith et al. | 482/121 |
| 7,223,220 | B2 | 5/2007 | Bendavid et al. | |
| 7,344,484 | B1 * | 3/2008 | Porcellato | 482/123 |
| 7,361,127 | B2 * | 4/2008 | Tremayne | 482/130 |
| 7,537,553 | B2 | 5/2009 | Mongelluzzo et al. | |
| 7,780,584 | B2 | 8/2010 | Alexander | |
| 2002/0142898 | A1 * | 10/2002 | Willis et al. | 482/130 |
| 2003/0092537 | A1 * | 5/2003 | Spencer | 482/77 |
| 2004/0043873 | A1 * | 3/2004 | Wilkinson et al. | 482/54 |
| 2005/0221963 | A1 * | 10/2005 | Prismall et al. | 482/92 |
| 2009/0017999 | A1 * | 1/2009 | Halbridge | 482/130 |

* cited by examiner

*Primary Examiner* — Loan H Thanh
*Assistant Examiner* — Gregory Winter
(74) *Attorney, Agent, or Firm* — RG Patent Consulting, LLC; Rachel Gilboy

(57) ABSTRACT

A chair-mounted exercise device to provide a more convenient means of exercising while in a seated position to enhance an individual's quality of life. A user attaches a chair-mounted exercise device to an office chair, dining chair, wheelchair, or the like and engages the handle of the device to perform exercises with various body members. A tubular casing encloses a resistance assembly that employs pulleys, a spring, a tensioning mechanism, and an elastic band to provide resistance to a user for the purpose of exercising. The chair-mounted exercise device is repositionable and easy to use.

3 Claims, 4 Drawing Sheets

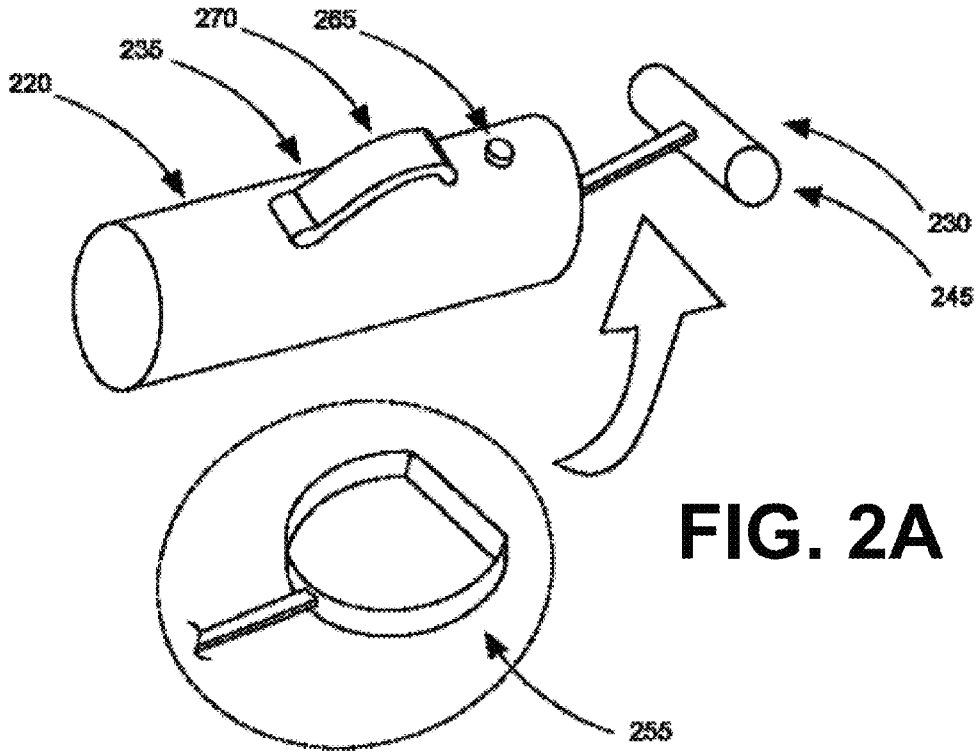
FIG. 2A
FIG. 2B
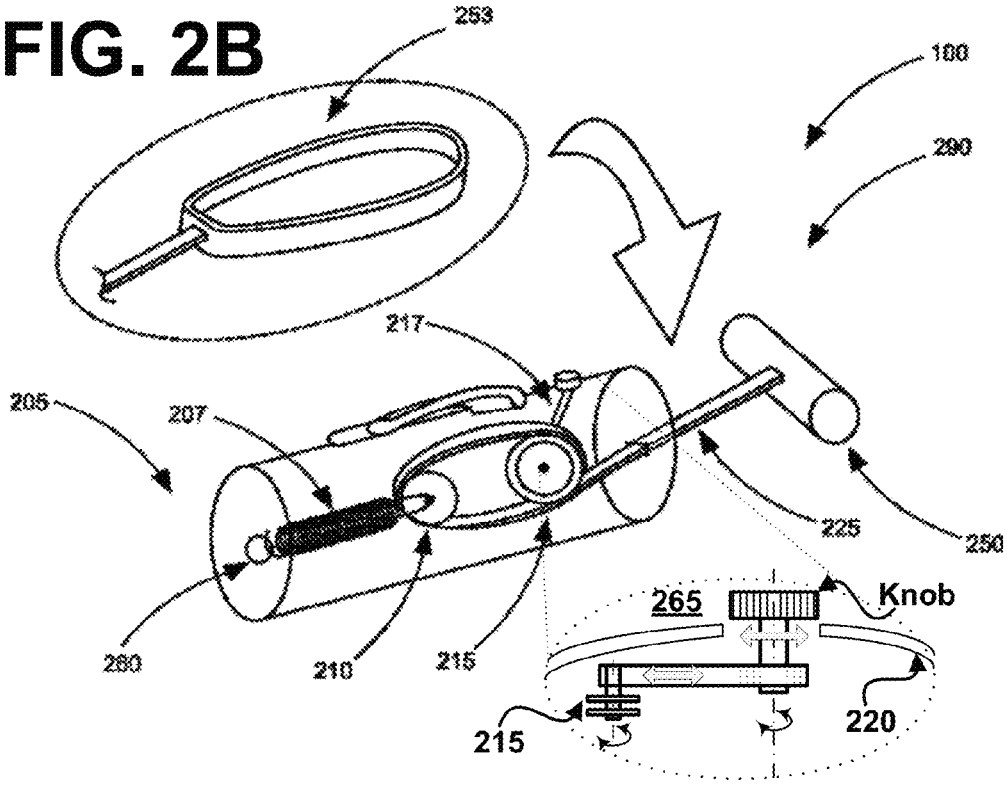

CHAIR EXERCISE SYSTEMS

CROSS-REFERENCE TO RELATED APPLICATION

The present application is related to and claims priority from prior provisional application Ser. No. 61/625,709, filed Apr. 18, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of portable exercise devices and more specifically relates to chair-mounted exercise devices for use by seated individuals.

2. Description of the Related Art

Many individuals in modern society spend a substantial amount of time in a seated position. Students sit through most class sessions. Office workers often sit behind a desk throughout the workday. Individuals in occupations outside an office setting, including ticket agents and toll booth operators, for example, also sit throughout a large portion of the workday. Likewise, individuals confined to wheelchairs are restricted to a seated position with limited opportunities for relief available to them. While spending so much time sitting, many of an individual's muscles and joints are often not engaged, and, therefore, can become stiff or weaken due to disuse. While so much emphasis and time are placed on one's career and providing for one's family, little time is left in a day for an individual to stretch and exercise. Also, many exercise devices and activities are cumbersome and are not adapted to accommodate wheelchair-bound individuals.

Various attempts have been made to solve the above-mentioned problems such as those found in U.S. Pat. Nos. 7,223,220; 6,159,133; 7,537,553; 7,780,584; 6,334,624; 4,572,501. This prior art is representative of portable exercise devices. None of the above inventions and patents, taken either singly or in combination, is seen to describe the invention as claimed.

Ideally, a chair-mounted exercise device for use by seated individuals should be compact, versatile, durable, user-friendly, and, yet, would operate reliably and be manufactured at a modest expense. Thus, a need exists for a reliable chair-mounted exercise devise system to increase the convenience of exercising while in a seated position to enhance a user's quality of life and to avoid the above-mentioned problems.

BRIEF SUMMARY OF THE INVENTION

In view of the foregoing disadvantages inherent in the known portable exercise device art, the present invention provides a novel Flexerciser Chair Exercise System. The general purpose of the present invention, which will be described subsequently in greater detail, is to provide a more convenient means of exercising while in a seated position to enhance an individual's quality of life.

A chair-mounted exercise device for use by seated individuals is disclosed herein preferably comprising: a resistance assembly, a casing, an elastic band, a handle, and a mounting attachment. In preferred embodiments, the casing is a tubular structure made of plastic. Housed within the casing, the resistance assembly preferably includes: at least one spring; at least one spring pulley; at least one tensioning pulley; and at least one tensioning mechanism, working in combination. The tensioning pulley is preferably attached to the interior wall of the casing, while the spring pulley floats within the casing. In preferred embodiments, the elastic band is attached at one end to the tensioning pulley. The length of the band is supported about the circumference of both the tensioning pulley and the spring pulley in such a way that the elastic band is confined by the pulleys to a designated path within the resistance assembly. The unattached end of the elastic band protrudes from one end of the casing and is affixed to a handle—a cylindrical soft grip in the present embodiment.

Ideally, the tensioning mechanism comprises a control. The tensioning mechanism engages the tensioning pulley within the casing, extends through the casing, and protrudes from the casing as the control. The tensioning mechanism is preferably connected to the tensioning pulley in such a manner as to increase, and alternately decrease, tension in the elastic band. In this way, the chair-mounted exercise device allows a user to manipulate the tension in the elastic band, thereby changing the resistance of the device and therefore the intensity of the exercise being performed. In order to provide additional resistance and proper tension between the pulleys within the resistance assembly, the spring is connected at one end to the casing and at the second end to the spring pulley.

The chair-mounted exercise device is adapted to mount to a chair via the mounting attachment. A chair, in the present embodiment, preferably comprises a wheelchair, though an office chair, dining chair, commercial transportation seat, or the like may be used. The mounting attachment preferably comprises a size-adjustable clip that is pivotally secured to the external wall of the device casing. The size-adjustable clip allows the chair-mounted exercise system to accommodate various chair types and sizes. The pivoting motion of the clip provides a user with easy access to the handle so as to engage in a variety of exercises for various body members.

A method of using the chair-mounted exercise device for use by seated individuals is also described herein preferably comprising the steps of: adjusting the tensioning mechanism to a desired tension level; securing the casing, which houses the resistance assembly, to a chair; engaging the handle with at least one body member to perform at least one exercise; repositioning the casing; and re-engaging the handle with at least one body member to perform at least one exercise. The method preferably further comprises the step of removing the casing until needed for a future use.

The present invention holds significant improvements and serves as a portable exercise system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Flexerciser Chair Exercise Systems, constructed and operative according to the teachings of the present invention.

FIGS. 2A and 2B are perspective views illustrating the chair-mounted exercise system according to an embodiment of the present invention of FIG. 1.

The various embodiments of the present invention will hereinafter be described in conjunction with the appended drawings, wherein like designations denote like elements.

DETAILED DESCRIPTION

As discussed above, embodiments of the present invention relate to a portable exercise device and more particularly to a Flexerciser Chair Exercise System as used to improve the convenience of exercising while seated to enhance a user's quality of life.

Figure 1:
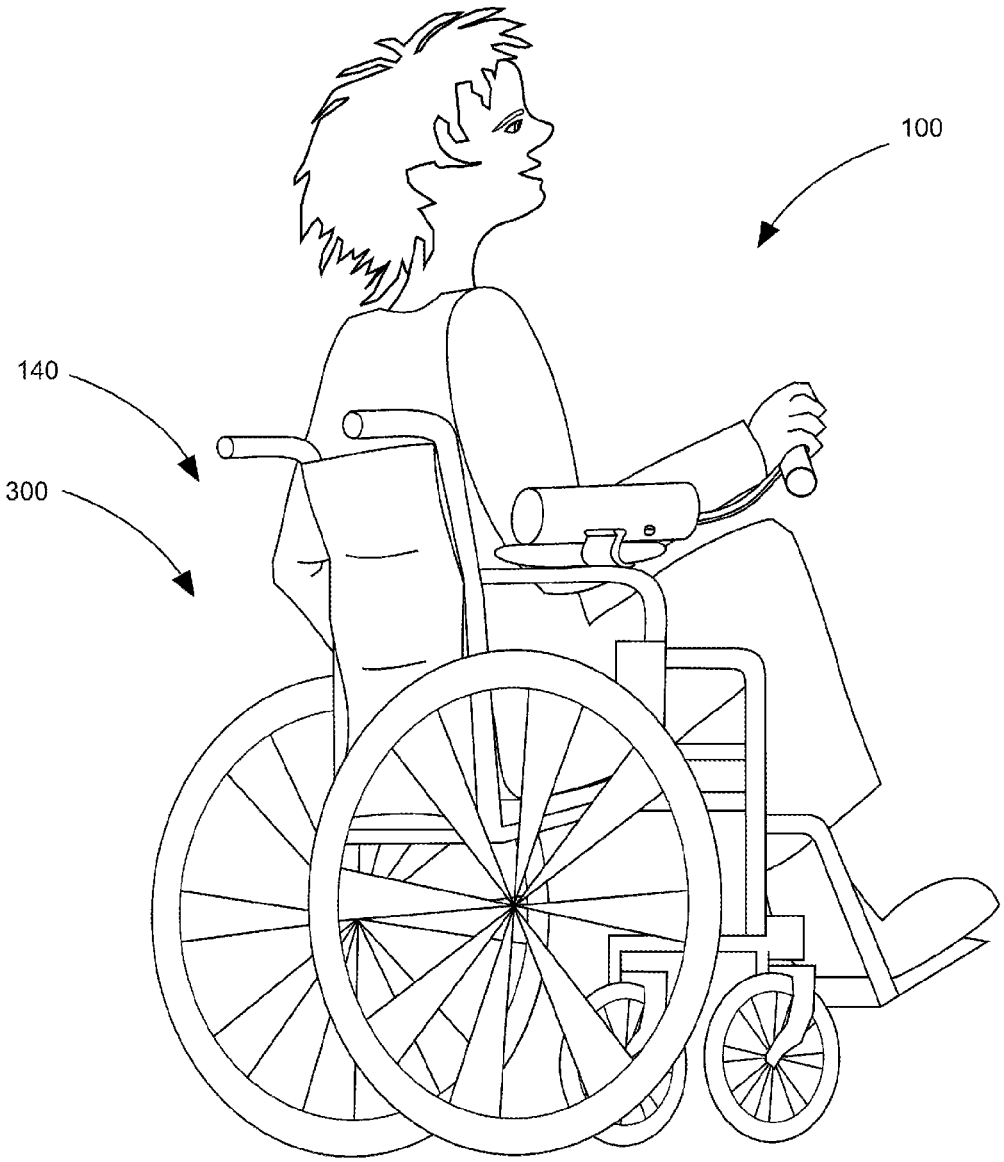
FIG. 1 shows a perspective view illustrating a chair-mounted exercise system according to an embodiment of the present invention.

Referring now to the drawings by numerals of reference there is shown in FIG. 1, a perspective view illustrating chair-mounted exercise system 100 according to an embodiment of the present invention.

Chair-mounted exercise system 100 preferably comprises: casing 220; at least one elastic band 225; at least one handle 230; at least one mounting attachment 235; and at least one resistance assembly 205, which preferably includes at least one spring 207, at least one spring pulley 210; at least one tensioning pulley 215, and at least one tensioning mechanism 217 having at least one control 265. Within this particular embodiment, chair-mounted exercise system 100 may be adapted to mount to chair 140 via mounting attachment 235 such that a user may engage handle 230 with a body member to complete at least one exercise and may reposition chair-mounted exercise system 100 during use. Chair-mounted exercise system 100 may preferably be repositionable in order to provide exercise options for various individual muscles and muscle groups throughout a user's body, e.g.—arms, legs, stomach, etc., so as to prevent stiffness, prevent muscle decomposition, increase alertness, and increase circulation for a user.

FIGS. 2A and 2B are perspective views illustrating chair-mounted exercise system 100 according to an embodiment of the present invention of FIG. 1.

Resistance assembly 205 preferably comprises spring 207, spring pulley 210, tensioning pulley 215, and tensioning mechanism 217 in combination, and is housed within casing 220. In preferred embodiments, casing 220 comprises a plastic tubular structure. Casing may alternately be constructed of metal, wood, composites, or the like. While a cylindrical tube is depicted in the present figure, casing 220 may be constructed in various shapes, such as rectangular tubes, pentagonal tubes, octagonal tubes, or the like in other embodiments. Those with ordinary skill in the art will now appreciate that upon reading this specification and by their understanding the art of canisters as described herein, methods of constructing lightweight, strong, and rigid canisters will be understood by those knowledgeable in such art.

Tensioning pulley 215 may preferably be pin connected to an interior wall of casing 220, while spring pulley 210 may preferably float within the confines of casing 220. In preferred embodiments, elastic band 225 may preferably be affixed at a proximate end to tensioning pulley 215 and may be supported along its length about a circumference of both tensioning pulley 215 and spring pulley 210. In this way, tensioning pulley 215 and spring pulley 210 may preferably confine elastic band 225 to a designated orientation within resistance assembly 205 and may transmit forces between spring pulley 210 and tensioning pulley 215. Those with ordinary skill in the art will now appreciate that upon reading this specification and by their understanding the art of pulley systems as described herein, methods of transmitting forces along a pulley system will be understood by those knowledgeable in such art.

Tensioning mechanism 217 may preferably engage tensioning pulley 215 within casing 220; extend through casing 220; and terminate in control 265, which acts in a capacity of an end cap as well as an adjustment knob in the present embodiment. Tensioning mechanism 217 may preferably be connected to tensioning pulley 215 so as to increase and alternately decrease tension in elastic band 225. Control 265 may preferably comprise a knob capable of twisting, a knob capable of sliding, a button, a toggle switch, or the like to provide adjustments via tensioning mechanism 217.

While tensioning mechanism 217 of the present embodiment may be manually adjusted, tensioning mechanism 217 of other embodiments may comprise motorized elements that may be electronically adjusted. Those with ordinary skill in the art will now appreciate that upon reading this specification and by their understanding the art of tension and resistance systems as described herein, methods of controlling and adjusting resistance levels within an exercise system will be understood by those knowledgeable in such art.

Optionally, some embodiments of the present invention may comprise a tensioning display (digital, etc.). Such a display may be embedded in, or externally attached to, an external wall of casing 220 in order to display the resistance level at which chair-mounted exercise system 100 is set.

Similarly, in some embodiments, chair-mounted exercise system 100 may comprise a repetition display useful in exhibiting the number of repetitions of an exercise completed by a user. Such a display may exist as a separate entity embedded in, or externally attached to, an exterior wall of casing 220, or may exist as a component of, or in combination with, the aforementioned optional tensioning display. Those with ordinary skill in the art will now appreciate that upon reading this specification and by their understanding the art of displays and display screens as described herein, methods of creating and implementing various displays will be understood by those knowledgeable in such art.

Also contributing to the resistance of resistance assembly 205, spring 207 may preferably be connected at a first end to an interior wall of casing 220 via spring ring 260, which preferably comprises a hook-and-eye closure in the present embodiment. Spring 207 may also preferably be connected at a second end to spring pulley 210 in such a manner as to provide additional resistance and proper tension within resistance assembly 205. In this way, spring 207 essentially ensures elastic band 225 remains securely in position along the pulley route defined by tensioning pulley 215 and spring pulley 210. Upon reading this specification, it should be appreciated that, under appropriate circumstances, considering such issues as user preferences, design preference, structural requirements, marketing preferences, cost, available materials, technological advances, etc., other attachment means and/or fastening arrangements such as, for example, hairpin clips, retaining rings, threaded fasteners, soldering, welding, crimping, etc., may be sufficient.

In the present embodiment, elastic band 225 may protrude from casing 220 and may be attached at a distal end to handle 230. Elastic band 225 may preferably be constructed of an elastomeric material. Physical properties of elastic band 225, such as width, length, thickness, resistance, etc., may be varied individually or in combination in a manner so as to alter the resistance and overall performance of chair-mounted exercise system 100 in order to meet the needs and/or preferences of a user. Those with ordinary skill in the art will now appreciate that upon reading this specification and by their understanding the art of elastomeric materials as described herein, methods of modifying physical properties of elastomeric materials will be understood by those knowledgeable in such art.

Within this particular embodiment shown, handle 230 may preferably releasably attached to elastic band 225, and may preferably comprises interchangeable handle attachment(s) 245. Handle attachment(s) 245 may preferably comprise: ring 255, as shown in FIG. 2A, strap 253, as shown in FIG. 2B, and cylindrical soft grip 250, as shown in both FIGS. 2A and 2B. Handle attachment(s) 245 of various shapes and sizes may be used in other embodiments according to the needs and preferences of a user. Handle 230, manifested in any handle attachment 245, may comprise wood, metal, plastic, foam, or the like. Upon reading this specification, it should be appreciated that, under appropriate circumstances, considering such issues as user preferences, design preference, structural requirements, marketing preferences, cost, available materials, technological advances, etc., other gripping material arrangements such as, for example, wood, foam, rubber, etc., may be sufficient.

Figure 3A:
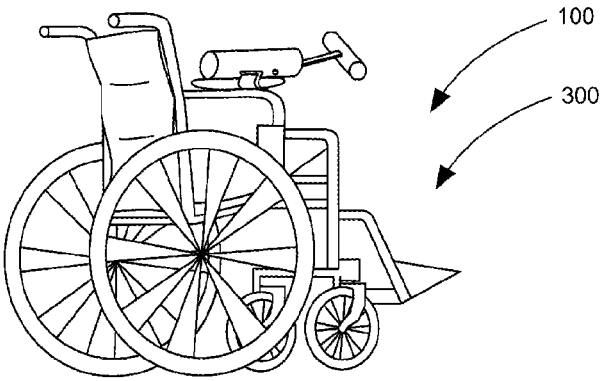
FIGS. 3A-3C are perspective views illustrating the chair-mounted exercise system mounted to a wheelchair, an office chair, and a commercial transportation seat, respectively, according to an embodiment of the present invention of FIG. 1.
Figure 3B:
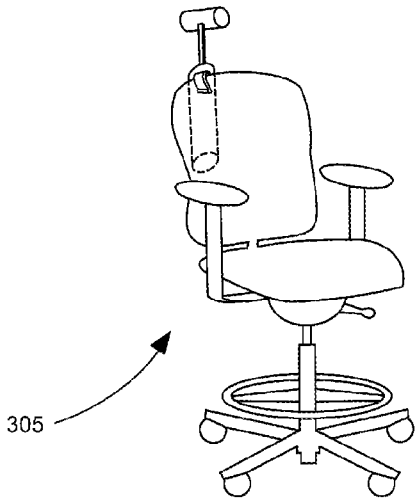
Figure 3C:
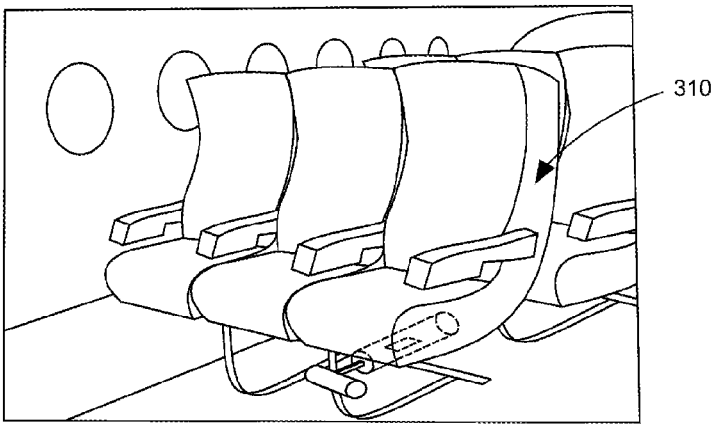

Referring now to FIGS. 3A-3C, perspective views illustrating chair-mounted exercise system 100 mounted to wheelchair 300, office chair 305, and commercial transportation seat 310, respectively, according to an embodiment of the present invention of FIG. 1.

Chair-mounted exercise system 100 may be used in combination with many types of chair(s) 140. In the present embodiment, chair 140 preferably comprises wheelchair 300, office chair 305, and commercial transportation seat 310 (such as those on airplanes, buses, trains, or the like). In other embodiments, chair 140 may comprise a student desk chair, a dining chair, a bar stool, a recliner, or the like. A versatile component of chair-mounted exercise system 100, mounting attachment 235 essentially allows a user to attach chair-mounted exercise system 100 to any chair 140. Mounting attachment 235 may preferably comprise clip 270. Clip 270 may preferably be size-adjustable to accommodate various chair 140 thicknesses. In order to accommodate various attachment angles and exercise positions, clip 270 may preferably be pivotally secured to an external wall of casing 220. This pivot attachment essentially allows a user to secure chair-mounted exercise system 100 to the back, arms, seat, etc. of chair 140 to accommodate various exercises. Upon reading this specification, it should be appreciated that, under appropriate circumstances, considering such issues as user preferences, design preference, structural requirements, marketing preferences, cost, available materials, technological advances, etc., other mounting arrangements such as, for example, Velcro®, clamps, hooks, etc., may be sufficient.

Chair-mounted exercise system 100 may be sold as kit 290 comprising the following parts: at least one resistance assembly 205 at least one casing 220; at least one elastic band 225; at least one handle 230; at least one mounting attachment 235; and at least one set of user instructions. Chair-mounted exercise system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 4:
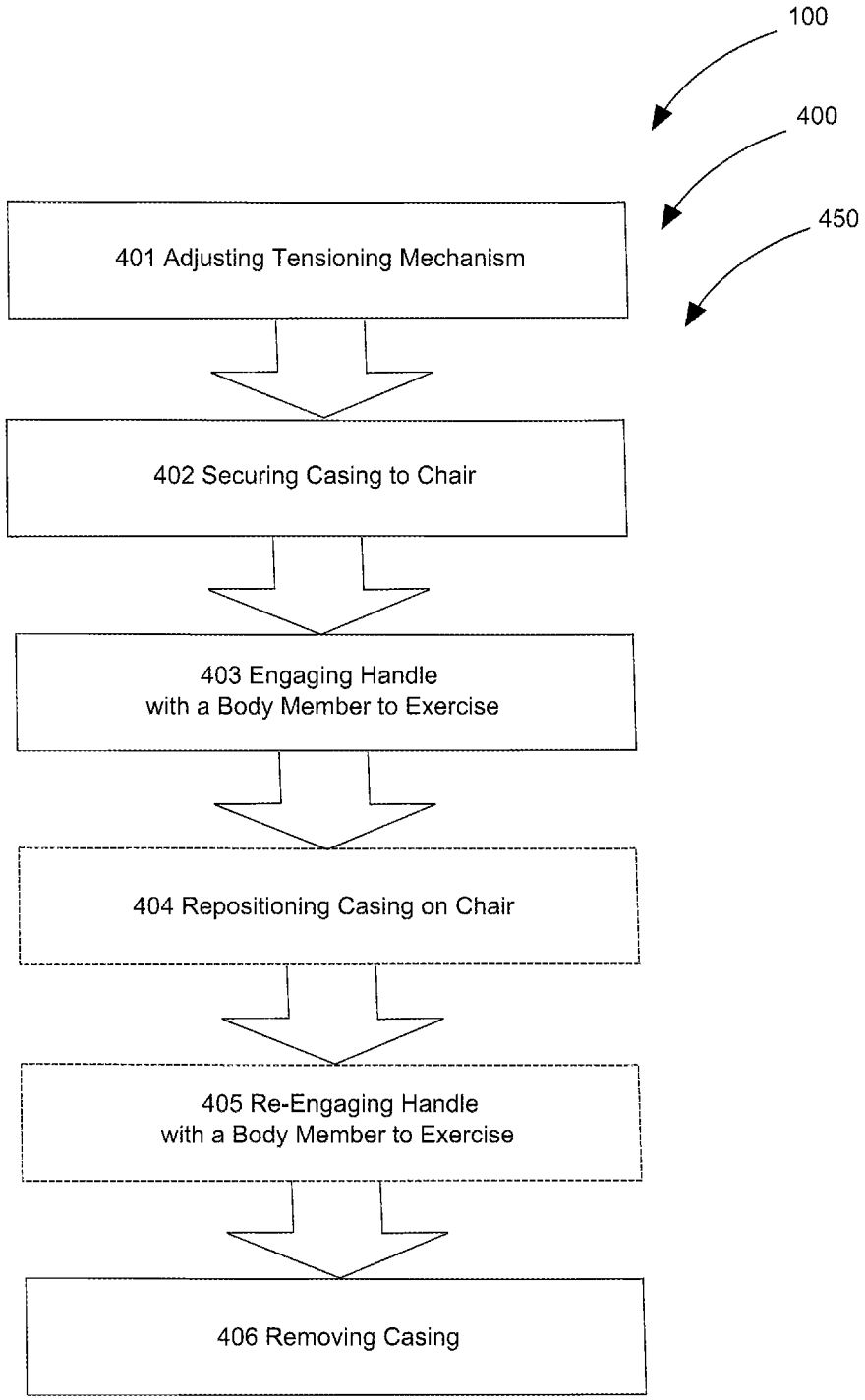
FIG. 4 is a flowchart illustrating the chair-mounted exercise system according to an embodiment of the present invention of FIGS. 1-3C.

Referring now to FIG. 4, a flowchart illustrating chair-mounted exercise system 100 according to an embodiment of the present invention of FIGS. 1-3C.

A method of using (at least hereby enabling method of use 400) chair-mounted exercise system 100 preferably comprises the steps of: step one 401 adjusting tensioning mechanism 217 to desired tension level; step two 402 securing casing 220, which houses resistance assembly 205, to chair 140; step three 403 engaging handle 230 with at least one body member to perform at least one exercise; step four 404 repositioning casing 220, which houses resistance assembly 205 on chair 140; and step five 405 re-engaging handle 230 with at least one body member to perform at least one exercise. The method of use 400 preferably further comprises the step of: step six 406 removing casing 220, which houses resistance assembly 205.

It should be noted that step four 404 and step five 405 are optional steps and may not be implemented in all cases. Optional steps of method 400 are illustrated using dotted lines in FIG. 4 so as to distinguish them from the other steps of method 400.

It should be noted that the steps described in the method of use can be carried out in many different orders according to user preference. The use of "step of" should not be interpreted as "step for", in the claims herein and is not intended to invoke the provisions of 35 U.S.C. §112, 916. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A chair-mounted exercise system comprising:

a) a chair;

b) a resistance assembly including;

i) a spring;

ii) a spring pulley;

iii) a tensioning pulley; and iv) a tensioning mechanism;

c) a casing;

d) an elastic band;

e) a handle; and f) a mounting attachment;

g) wherein said resistance assembly comprises said spring, said tensioning pulley, said spring pulley, and said tensioning mechanism in combination, and is connected to and supported by said casing;

h) wherein said elastic band is affixed at a proximate end to said tensioning pulley and is supported along its length about a circumference of each said tensioning pulley and said spring pulley in such a manner as to require that said tensioning pulley and said spring pulley confine said elastic band to a designated orientation within said resistance assembly;

i) wherein said elastic band protrudes from said casing and is attached at a distal end to said handle;

j) wherein said tensioning mechanism is connected to said tensioning pulley so as to increase and alternately decrease tension in said elastic band;

k) wherein said tensioning mechanism comprises a control;

l) wherein said tensioning mechanism engages said tensioning pulley within said casing, extends through said casing, and protrudes from said casing as said control;

m) wherein said spring is connected at a first end to said casing and is connected at a second end to said spring pulley to provide additional resistance and proper tension within said resistance assembly;

n) wherein said tensioning pulley is affixed to an interior wall of said casing and said spring pulley floats within said casing;

o) wherein said casing comprises a plastic tubular structure;

p) wherein said handle comprises interchangeable handle attachments including a cylindrical soft grip;

q) wherein said mounting attachment comprises a size-adjustable clip pivotally secured to an external wall of said casing;

r) wherein said chair comprises a wheelchair; and s) wherein said chair-mounted exercise system is adapted to mount to said chair via said mounting attachment such that a user may readily engage said handle with a body member to complete at least one exercise and may reposition said chair-mounted exercise system during use.

2. A method of using a chair-mounted exercise system comprising the steps of:

a) providing the chair-mounted exercise system of claim 1;

b) adjusting said tensioning mechanism to a desired tension level;

c) securing said casing which houses said resistance assembly to said chair;

d) engaging said handle with at least one body member to perform at least one exercise;

e) repositioning said casing which houses said resistance assembly on said chair; and f) re-engaging said handle with said at least one body member to perform at least one exercise.

3. The method of claim 2 further comprising the step of removing said casing which houses said resistance assembly.

* * * * *